US011090894B2

(12) United States Patent
Mourad et al.

(10) Patent No.: US 11,090,894 B2
(45) Date of Patent: Aug. 17, 2021

(54) METAL CHIPS COMPACTOR

(71) Applicants: United Arab Emirates University, Al Ain (AE); Khalfan Saeed Seraidy, Fujairah (AE)

(72) Inventors: Abdel Hamid Ismail Mourad, Al Ain (AE); Ebrahim Al Ali, Al Ain (AE); Rashed Abdulla Al Ali, Al Ain (AE); Khaled Ahmed Al Houqani, Al Ain (AE); Yosuef Ahmed Al Nuaimi, Al Ain (AE); Khaled Obaid Al Falahi, Al Ain (AE); Humaid Ahmed Al Hammadi, Al Ain (AE); Ahmed Saeed Seraidy, Al Ain (AE); Hamad Musfer Al Korbi, Al Ain (AE); Rashed Mohammed Al Falasi, Al Ain (AE)

(73) Assignee: UNITED ARAB EMIRATES UNIVERSITY, Al Ain (AE)

( * ) Notice: Subject to any disclaimer, the term of this patent is extended or adjusted under 35 U.S.C. 154(b) by 529 days.

(21) Appl. No.: 15/351,665

(22) Filed: Nov. 15, 2016

(65) Prior Publication Data

US 2017/0136721 A1 May 18, 2017

Related U.S. Application Data

(60) Provisional application No. 62/255,716, filed on Nov. 16, 2015.

(51) Int. Cl.

| | |
|---|---|
| ***B30B 9/32*** | (2006.01) |
| ***B30B 15/32*** | (2006.01) |
| ***B30B 15/14*** | (2006.01) |

(52) U.S. Cl.

CPC ..... *B30B 9/327* (2013.01); *B30B 15/148* (2013.01); *B30B 15/32* (2013.01)

(58) Field of Classification Search

CPC ..... Y10S 100/903–904; B30B 9/062; B30B 9/067; B30B 9/3064; B30B 9/3089;

(Continued)

(56) References Cited

U.S. PATENT DOCUMENTS

| | | | | |
|---|---|---|---|---|
| 302,327 A * | 7/1884 | Ebert | ..... | B30B 1/18 100/289 |
| 2,374,363 A * | 4/1945 | McCaskell | ..... | B01D 35/14 198/548 |

(Continued)

FOREIGN PATENT DOCUMENTS

| | | | | |
|---|---|---|---|---|
| GB | 781556 A * | 8/1957 | ..... | B21C 23/01 |
| GB | 1346017 A * | 2/1974 | ..... | B30B 1/18 |
| GB | 1518842.8 * | 10/2015 | ..... | B30B 1/18 |

OTHER PUBLICATIONS

Gopinath, R. "Design of a Power Screw," 2014, Middle-East Journal of Scientific Research, 20 (5). pp. 630-634 (Year: 2014).*

*Primary Examiner* — Shelley M Self
*Assistant Examiner* — Katie L. Parr
(74) *Attorney, Agent, or Firm* — MH2 Technology Law Group, LLP

(57) ABSTRACT

There is provided an apparatus for compacting metal chips comprising a power screw; a compactor cylinder adapted to receive metal chips from one end and to receive the power screw from another end to compact the metal chips; a worm gear operably connected to the power screw for applying pressure to the compactor cylinder; a motor; a worm screw adapted to be powered by the motor and to be connected to the worm gear for rotating the worm gear when the motor is in operation; a sensor for measuring the velocity of the power screw; and a microcontroller adapted to be connected to the motor and to the sensor; wherein the microcontroller is adapted to power the motor for rotation as long as the velocity of the power screw is above a given velocity (Continued)

threshold and to stop powering the motor when the velocity reaches said given velocity threshold.

13 Claims, 4 Drawing Sheets

(58) Field of Classification Search
CPC .. B30B 9/124; B30B 9/18; B30B 9/32; B30B 9/327; B30B 9/328; B30B 11/02; B30B 11/24; B30B 11/26; B30B 15/0047; B30B 15/0094; B30B 15/161; B30B 15/18; B30B 15/148; B30B 15/32; B30B 1/18; B30B 1/181; B30B 1/186; B30B 9/3007; B30B 9/3014
USPC ..... 100/145, 147–149, 179, 191, 192, 240, 100/245, 289, 903–904, 906; 72/452, 454
See application file for complete search history.

(56) References Cited

U.S. PATENT DOCUMENTS 3,168,033 A * 2/1965 Hansen ..... B30B 9/067 100/116
3,178,958 A * 4/1965 Beck ..... F16H 25/2204 74/424.83
4,782,749 A * 11/1988 Iwasaki ..... B30B 1/23 100/271
5,001,975 A * 3/1991 Finden ..... B30B 9/067 100/232
5,108,040 A * 4/1992 Koenig ..... B30B 11/246 241/260.1
5,137,489 A * 8/1992 Boster ..... B30B 9/121 100/121
5,873,304 A * 2/1999 Ruf ..... B30B 9/30 100/215
6,571,695 B1 * 6/2003 Holmen ..... B26F 1/24 100/151
8,720,330 B1 * 5/2014 Koenig ..... B30B 9/18 100/337
9,403,336 B2 * 8/2016 Koenig ..... B30B 9/3014
9,614,418 B2 * 4/2017 Furukawa ..... H02K 11/20
2001/0050006 A1 * 12/2001 Nakamura ..... B30B 9/065 100/37
2004/0069163 A1 * 4/2004 White ..... B30B 1/18 100/289
2006/0283229 A1 * 12/2006 Futamura ..... B30B 1/186 72/443
2007/0023949 A1 * 2/2007 Nakamura ..... B01D 33/015 264/109
2007/0251342 A1 * 11/2007 Murao ..... F16H 25/229 74/59
2018/0147805 A1 * 5/2018 Sashida ..... B30B 9/32

* cited by examiner

METAL CHIPS COMPACTOR

CROSS REFERENCE TO RELATED APPLICATIONS

This application claims the benefit of, and relies on the filing date of, U.S. provisional patent application No. 62/255,716, filed 16 Nov. 2015, the entire disclosure of which is incorporated herein by reference.

FIELD OF THE INVENTION

This invention relates to metal compacting apparatus, and particularly to metal compactors that compact incompressible metal shavings, chips and the like into easily transportable cylindrical pellets.

BACKGROUND OF THE INVENTION

During fabrication of metal parts, production of metal chips or shavings happens during normal course. However, an increased amount of such waste provides a problem for transportation of such metal chips or shavings.

Traditional systems fail to provide efficient, inexpensive, easy to use, and portable metal compactors.

SUMMARY OF THE INVENTION

There is provided an apparatus and process for compacting metal chips which overcome the above mentioned drawbacks.

As a first aspect of the invention, there is provided an apparatus for compacting metal chips comprising:

a power screw;

a compactor cylinder adapted to receive metal chips from one end and to receive the power screw from another end to compact the metal chips;

a worm gear operably connected to the power screw for applying pressure to the compactor cylinder;

a motor;

a worm screw adapted to be powered by the motor and to be connected to the worm gear for rotating the worm gear when the motor is in operation;

a sensor 302 for measuring the velocity of the power screw; and a microcontroller adapted to be connected to the motor and to the sensor 302, wherein the microcontroller is adapted to power the motor for rotation as long as the velocity of the power screw is above a given velocity threshold and to stop powering the motor when the velocity reaches said given velocity threshold.

Preferably, the apparatus further comprises:

a base plate for supporting the apparatus; and a top plate supported by vertical columns, wherein the vertical columns are connected to the top plate and the base plate, thereby providing support to the apparatus.

Preferably, the apparatus further comprises a plurality of motion guides fixed on the top plate to guide the power screw.

Preferably, the motion guides are L shaped.

Preferably, the apparatus further contains an injector block positioned at a base of the compactor cylinder.

Preferably, the metal chips are aluminum chips.

Preferably, the motor is supported by a motor plate.

Preferably, the motor is a DC motor.

Preferably, the worm screw passes through a metal bushing.

Preferably, the apparatus further includes a pneumatic device adapted to exert pneumatic force to move the injector block towards the base of the compactor cylinder.

Preferably, the pneumatic device pushes the injector block for ejecting the compacted metal chips outside the compactor cylinder.

Preferably, the compacted metal chips are disk or cylinder like shapes.

Preferably, the given velocity threshold is zero.

Preferably, the apparatus further comprises a user interface for controlling the microcontroller by a user.

In an embodiment of the invention, the present invention is directed to a portable, inexpensive, and easy to use compactor for compacting metal chips and metal shavings to cylindrical or disk shaped pellets. The shavings or chips are compacted into a compressed pellet suitable for easy handling and transportation.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter that is regarded as the invention is particularly pointed out and distinctly claimed in the claims at the conclusion of the specification. The foregoing and other aspects, features, and advantages of the invention are apparent from the following detailed description, taken in conjunction with the accompanying drawings in which:

It is to be noted that the drawings presented are intended solely for the purpose of illustration and that they are, therefore, neither desired nor intended to limit the disclosure to any or all of the exact details of construction shown, except insofar as they may be deemed essential to the claimed invention.

DETAILED DESCRIPTION

Figure 1:
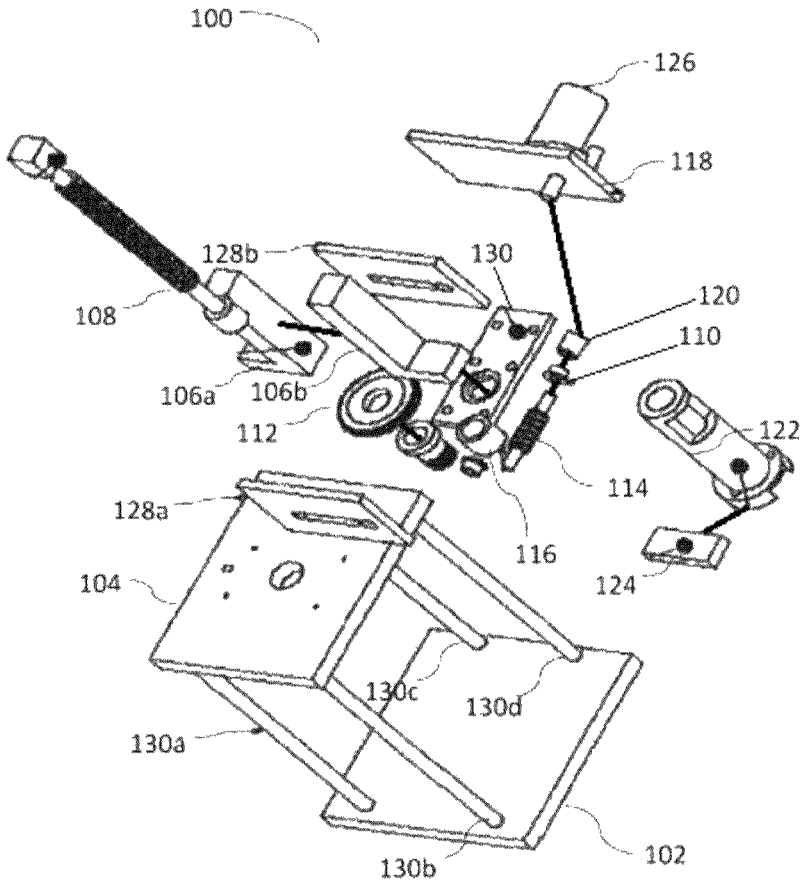
FIG. 1 illustrates an exploded view of a metal chip compactor in accordance with an embodiment of the invention.
Figure 3:
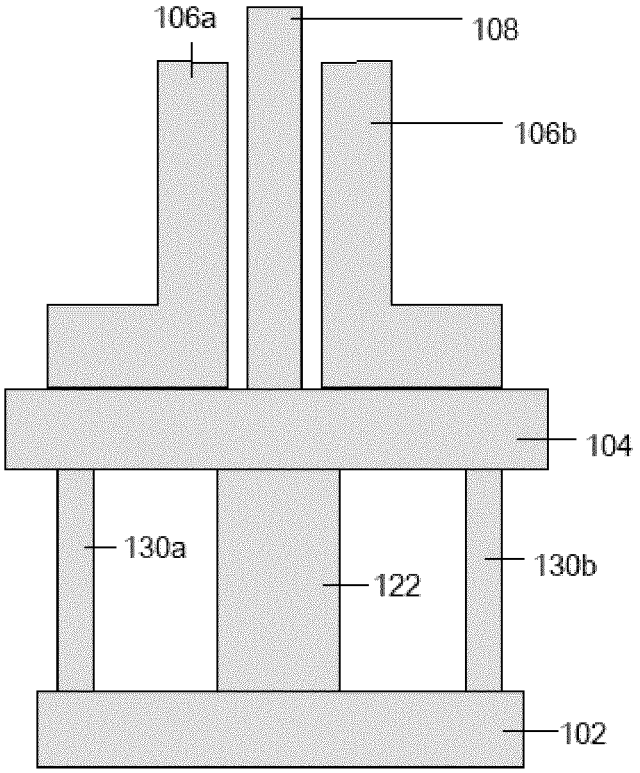
FIG. 3 is a side view of the metal chip compactor in accordance with an embodiment of the invention.
Figure 4:
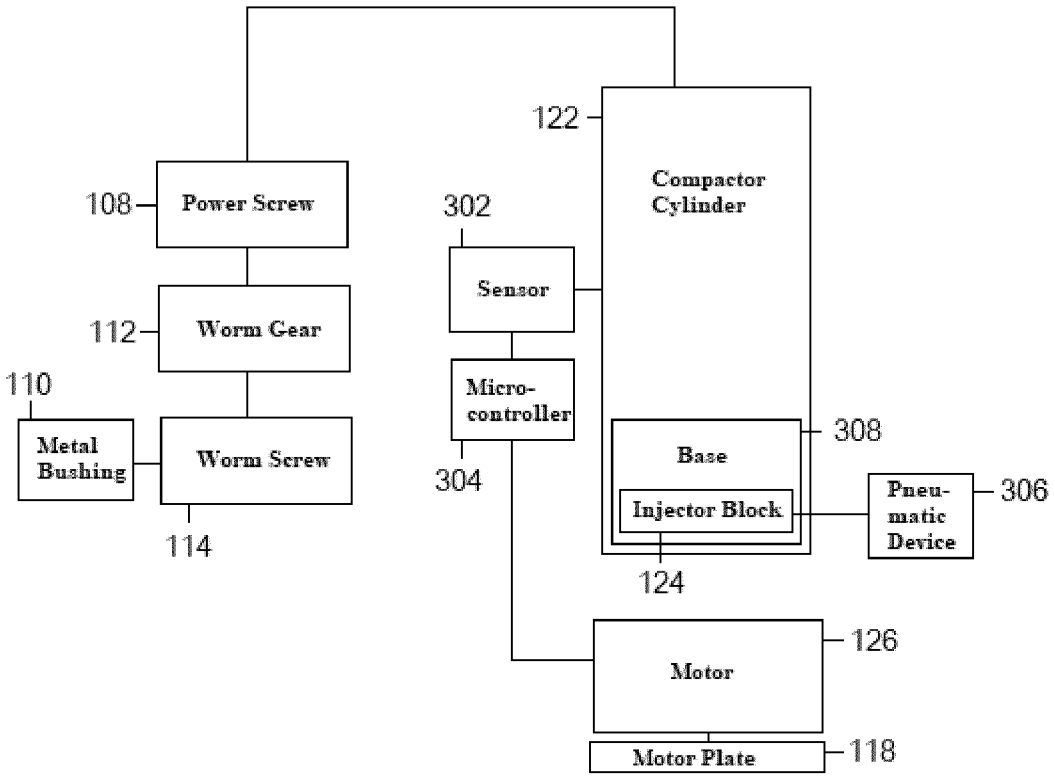
FIG. 4 is a block diagram of the overall apparatus for compacting metal chips in accordance with an embodiment of the invention.

FIG. 1 illustrates an exploded view of a metal compactor 100 in accordance with an embodiment of the invention. FIG. 3 is a side view of the metal chip compactor in accordance with an embodiment of the invention. FIG. 4 is a block diagram of the overall apparatus for compacting metal chips in accordance with an embodiment of the invention. The metal compactor 100 comprises a base plate 102 for supporting the compactor 100. The compactor 100 preferably compacts metal chips into cylindrical or disk shape metal chips. The metal chips can be any kind of metal, including but not limited to aluminum chips. The compactor 100 further comprises a top plate 104. The top plate 104 is supported by a plurality of vertical columns 130*a*, 130*b*, 130*c* and 130*d*.

The vertical columns 130*a*, 130*b*, 130*c* and 130*d* may be either screwed in to the base plate 102 and the top plate 104 or may be welded. The compactor 100 further comprises a power screw 108 that is placed in between the base plate 102 and the top plate 104. The power screw 108 is further configured to move in between the base plate 102 and the top plate 104 such that the movements of the power screw 108 facilitate the compaction of the metal chips or shavings. The apparatus further comprises a plurality of motion guides 106*a* and 106*b*, which are fixed on the top plate 104 to guide the power screw 108. The motion guides 106*a* and 106*b* are preferably L shaped, as seen in FIG. 1. The power screw 108 is operably connected to a worm gear 112. The worm gear 112 is supported by two support gear plates 128*a*, 128*b*. The support gear plates 128*a*, and 128*b* help retain the worm gear 112 in place for efficient operation. In addition to the support gear plates 128*a*, and 128*b*, there is also provided a fixer plate 130 to provide a base for the support gear plates 128*a*, and 128*b* at one end. The support gear plates 128*a*, and 128*b* are either bolted, screwed or welded to the fixer plate 130 at one end and either bolted, screwed or welded to the top plate 104 at the other end.

A worm screw 114 is connected to a rotating DC motor 126 through a bushing 110 and a coupler 120 and a motor plate 118 which is supported by the fixer plate 130 and the top plate 104 through fixing screws or bolts. The rotation of the DC motor 126 is further controlled by a microcontroller 304. The worm screw 114 is configured to be rotated by the DC motor 126 that is connected to the worm gear 112 for rotation thereof. The rotation of the worm gear 112 rotates the power screw 108 which exerts a downward force towards the base plate 102. The compactor 100 further comprises a compactor cylinder 122 which is configured to receive the power screw 108 when it is rotating and exerting a downward compression force on the metal chips and shavings to be compacted. The compactor 100 also comprises a pneumatic device 306 preferably comprising a regulator and an air tank. Other force exerting means/devices can be used such as mechanical force exerting means/devices. The pneumatic device 306 is attached to an injector block 124. The injector block 124 is movable inside and outside of an opening at the base 308 of the compactor cylinder 122.

Figure 2:
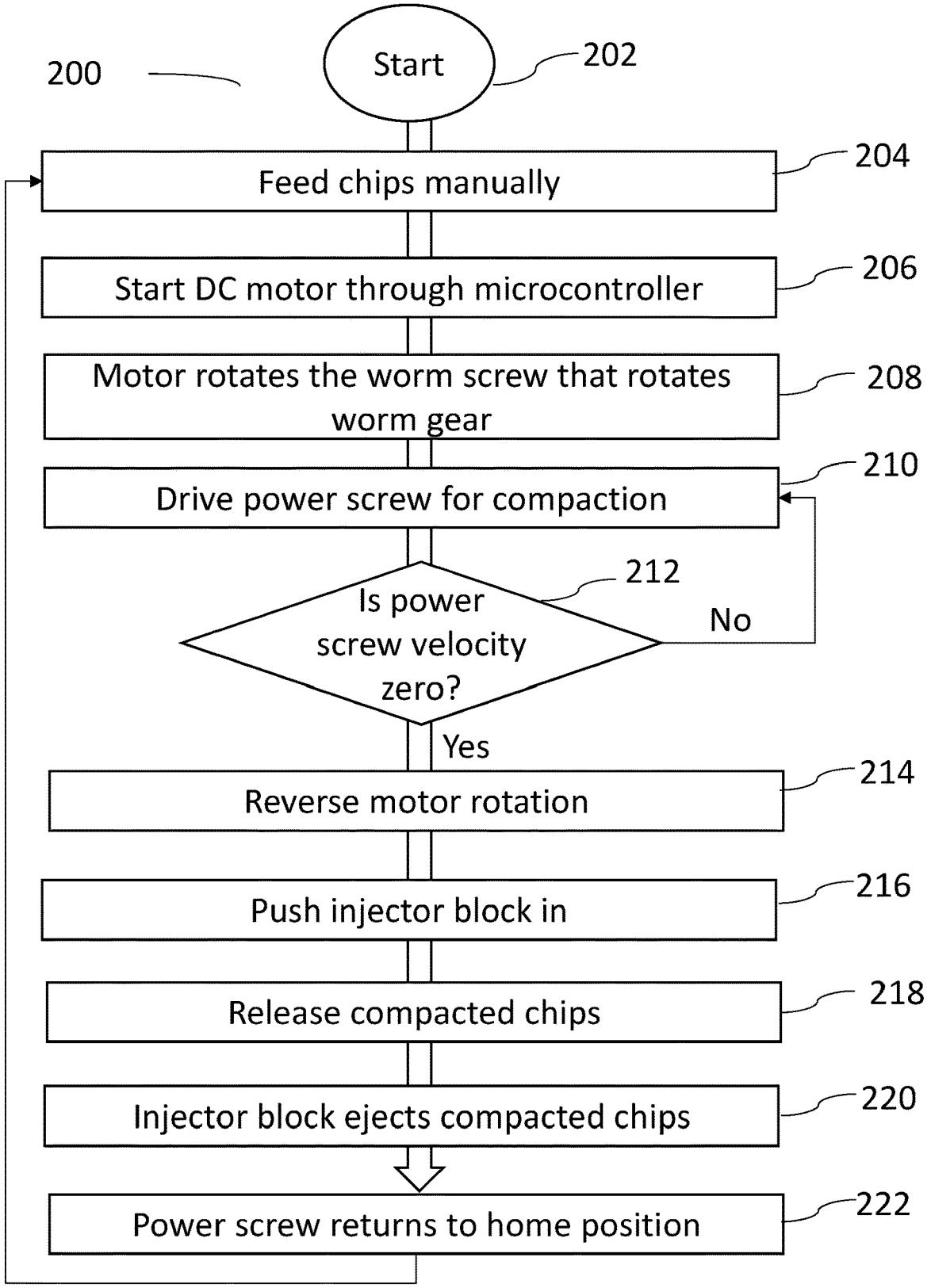
FIG. 2 is a flow chart depicting a process of compacting metal chips in accordance with an embodiment of the invention.

Referring to FIG. 2, there is provided a process 200 for compacting metal chips using a compactor 100 in accordance with an embodiment of the invention. The process 200 starts at step 202 where the system is reset from the microcontroller 304. At step 204, the metal chips are fed into the compactor cylinder 122. This operation of feeding the chips can be manual. At step 206, the DC motor 126 is started through the microcontroller 304 for rotating the worm screw 114. The DC motor 126 rotates the connected worm screw 114 at step 208, which in turn provides rotation to the rotatably connected worm gear 112.

Further, at step 210 the rotating worm gear 112 provides driving power to the power screw 108 to put it in operation for compacting the metal chips. During step 212, as long as the velocity of the power screw 108 is not zero, the compaction process continues. The velocity is preferably measured continuously throughout step 212. When the velocity of the power screw 108 is measured to be zero, then at step 214, the motor rotation is reversed. After retracting the power screw 108 to a certain predetermined limit, the reverse rotation of the motor 126 is halted. At step 216, the injector block 124 is pushed inside the compactor cylinder 122 by providing pneumatic power using the pneumatic device 306. After pushing the injector block 124 inside the compactor cylinder 122, at step 218 the compacted chips are pushed by the power screw 108 towards the base plate 102. At step 220, the pneumatic device 306 provides power and pushes the injector block 124 outwardly for ejecting the compacted chips outside of the compactor 100. After this, at step 222 the power screw 108 returns to its home position to begin a new processing cycle.

The foregoing description and drawings comprise illustrative embodiments of the present invention. Having thus described exemplary embodiments, it should be noted by those ordinarily skilled in the art that these disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one ordinarily skilled in the art to which this invention pertains having the benefit of the teachings presented in the foregoing descriptions and the associated drawings. Although specific terms may be employed herein, they are used in a generic and descriptive sense only and not for purposes of limitation. Moreover, the present invention has been described in detail; it should be understood that various changes, substitutions and alterations can be made thereto without departing from the spirit and scope of the invention as defined by the appended claims. Accordingly, the present invention is not limited to the specific embodiments illustrated herein, but is limited only by the following claims.

The invention claimed is:

1. An apparatus for compacting metal chips comprising:

a power screw for compacting the metal chips;

a compactor cylinder adapted to receive the power screw; wherein the compactor cylinder receives metal chips from a first end;

a worm gear for rotating and moving the power screw from a top plate to a base plate of the apparatus, thereby exerting a downward compression force towards the base plate and thereby on the metal chips which facilitates compacting of the metal chips;

two support gear plates for supporting the worm gear and helping to retain the worm gear in place for efficient operation, and a fixer plate for providing a base support for the two support gear plates at one end of the support gear plates, wherein the support gear plates are screwed or welded to the fixer plate at one end and screwed or welded to the top plate at another end;

a motor;

a worm screw adapted to be powered by the motor and to be connected to the worm gear for rotating the worm gear when the motor is in operation;

a sensor for continuously measuring a velocity of the power screw; and a microcontroller adapted to be connected to the motor and to the sensor;

wherein the microcontroller is adapted to power the motor for rotation for continuing a compaction process as long as the velocity of the power screw is above a given velocity threshold and to stop powering the motor when the velocity reaches said given velocity threshold during the compaction process, and wherein movements of the power screw facilitate compaction of the metal chips and compacted metal chips are ejected using an injector block, wherein a pneumatic device attached to the injector block pushes the injector block outwardly for ejecting the compacted metal chips outside the compactor cylinder.

2. The apparatus of claim 1, wherein the top plate of the apparatus is supported by a plurality of vertical columns, the plurality of vertical columns screwed in or welded to both the top plate and the base plate of the apparatus for support.

3. The apparatus of claim 1, wherein the apparatus further comprises a plurality of motion guides fixed on the top plate of the apparatus for guiding the power screw through the apparatus.

4. The apparatus of claim 3, wherein the plurality of motion guides are L-shaped.

5. The apparatus of claim 1, wherein the injector block is positioned at a base of the compactor cylinder.

6. The apparatus of claim 1, wherein the metal chips are aluminum chips.

7. The apparatus of claim 1, wherein the motor is supported by a motor plate.

8. The apparatus of claim 1, wherein the motor is a DC motor.

9. The apparatus of claim 1, wherein the worm screw passes through a metal bushing.

10. The apparatus of claim 5, wherein the injector block is movable inside and outside of an opening at the base of the compactor cylinder.

11. The apparatus of claim 1, wherein the compacted metal chips are disk or cylinder shaped.

12. The apparatus of claim 1, wherein the given velocity threshold is zero.

13. The apparatus of claim 1, wherein the power screw moves from the top plate to the base plate for pushing the compacted metal chips towards the base plate of the apparatus, and subsequently returns to a position of the top plate.

* * * * *